US008303727B2

(12) United States Patent
Burgess et al.

(10) Patent No.: US 8,303,727 B2
(45) Date of Patent: Nov. 6, 2012

(54) STEAM GENERATOR FOR A DISHWASHER

(75) Inventors: Brent M. Burgess, Edwardsburg, MI (US); Josef Arnold Buser, Schoenenberg-Kuebelberg (DE); Jordan Robert Fountain, Saint Joseph, MI (US); Sathish Andrea Sundaram, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 724 days.

(21) Appl. No.: 12/340,919

(22) Filed: Dec. 22, 2008

(65) Prior Publication Data

US 2010/0154842 A1 Jun. 24, 2010

(51) Int. Cl.
*B08B 3/00* (2006.01)

(52) U.S. Cl. ..... 134/56 D; 134/57 D

(58) Field of Classification Search ..... None
See application file for complete search history.

(56) References Cited

U.S. PATENT DOCUMENTS

| | | | | |
|---|---|---|---|---|
| 3,049,136 | A * | 8/1962 | Van Scoyk | 134/95.2 |
| 3,049,450 | A * | 8/1962 | Koons et al. | 134/11 |
| 4,246,916 | A * | 1/1981 | Fay et al. | 134/105 |
| 5,263,343 | A | 11/1993 | Lee | |
| 5,291,758 | A | 3/1994 | Lee | |
| 5,293,761 | A | 3/1994 | Jang | |
| 5,315,727 | A | 5/1994 | Lee | |
| 6,789,404 | B2 | 9/2004 | Kim et al. | |
| 6,874,191 | B2 | 4/2005 | Kim et al. | |
| 2006/0016020 | A1 | 1/2006 | Park | |
| 2006/0118145 | A1 * | 6/2006 | Woo Woo | 134/56 D |
| 2007/0029313 | A1 * | 2/2007 | Kanzaki et al. | 219/682 |
| 2007/0228032 | A1 * | 10/2007 | Reiter et al. | 219/543 |

FOREIGN PATENT DOCUMENTS

| | | | |
|---|---|---|---|
| DE | 19743508 | A1 | 4/1999 |
| DE | 10260163 | A1 * | 7/2004 |
| EP | 1275767 | A1 | 1/2003 |
| EP | 1862103 | A1 | 12/2007 |
| WO | 2006/101361 | A1 | 9/2006 |
| WO | 2006/101362 | A1 | 9/2006 |
| WO | 2006/101372 | A1 | 9/2006 |

OTHER PUBLICATIONS

Stickel, Martin, Jul. 2004, DE10260163A1, English machine translation.*

* cited by examiner

*Primary Examiner* — Michael Barr
*Assistant Examiner* — Jason Ko
(74) *Attorney, Agent, or Firm* — Jacquelyn Lin; Diederiks & Whitelaw PLC

(57) ABSTRACT

A dishwasher includes a steam-generating vessel positioned in the wash chamber of the dishwasher's tub. A heating element heats water contained in the vessel to generate steam. The heating element may be embodied as thick-film heating element. The steam-generating vessel may be formed in the dishwasher's tub or embodied as a separate component that is secured to the tub.

20 Claims, 5 Drawing Sheets

STEAM GENERATOR FOR A DISHWASHER

TECHNICAL FIELD

The present disclosure relates generally to a dishwasher and more particularly to a steam generator for a dishwasher.

BACKGROUND

A dishwasher is a domestic appliance into which dishes and other cooking and eating wares (e.g., plates, bowls, glasses, flatware, pots, pans, bowls, etcetera) are placed to be washed. A dishwasher includes a number of dishwasher racks which support such wares. Some dishwashers generate steam to facilitate the removal of tough soils such as burned-on or baked-on soils.

SUMMARY

According to one aspect, a dishwasher includes a steam-generating vessel positioned in the wash chamber of the dishwasher's tub. A heating element heats water contained in the vessel to generate steam. The heating element may be embodied as any type of heating element including a thick-film heating element. The steam-generating vessel may be formed in the dishwasher's tub or embodied as a separate component that is secured to the tub.

According to another aspect, a dishwasher includes a tub defining a washing chamber. The tub includes a bottom wall having an upper surface which faces the washing chamber and a lower surface which faces away from the washing chamber. The bottom wall has a recirculation sump formed therein which extends downwardly from the upper surface of the bottom wall. The bottom wall also has formed therein a steam-generating vessel which extends upwardly from the upper surface of the bottom wall. The dishwasher also includes a number of dish racks positioned in the chamber. A heating element is positioned below the bottom wall of the tub. The heating element is operable to heat the steam-generating vessel formed in the bottom wall of the tub.

In some embodiments, the steam-generating vessel includes an outer wall which extends upwardly from the upper surface of the bottom wall of the tub. The outer wall has a lower edge which is secured to the upper surface of the bottom wall of the tub and an upper edge. The steam-generating vessel also includes a lower wall secured to the outer wall at a location between the lower edge of the outer wall and the upper edge of the outer wall.

The outer wall of the steam-generating vessel may be cylindrically shaped or shaped in any other manner that contains fluid. It may also be shaped to conform to the bottom of the tub in an aesthetically pleasing manner.

The outer wall of the steam-generating vessel may be embodied as a continuous wall that envelops the lower wall of the steam-generating vessel. The outer wall of the steam-generating vessel and the lower wall of the steam-generating vessel create a fluid-retaining cavity.

The dishwasher also includes a machine compartment located below the bottom wall of the tub. The heating element may be located in the machine compartment. The machine compartment is sealed from the tub.

The heating element may be embodied as a thick-film heating element.

According to another aspect, a dishwasher includes a tub defining a washing chamber. The tub includes a bottom wall having an upper surface which faces the washing chamber and a lower surface which faces away from the washing chamber. A number of dish racks are positioned in the washing chamber. A machine compartment is positioned below the bottom wall of the tub. A thick-film heating element is positioned in the machine compartment. The thick-film heating element is operable to heat the bottom wall of the tub.

The thick-film heating element may include a base with a heating surface extending upwardly therefrom. The heating surface of the thick-film heating element is in thermal contact with the bottom wall of the tub.

The heating surface of the thick-film heating element may be positioned in contact with the lower surface of the bottom wall of the tub.

The bottom wall of the tub may have a housing formed therein. The housing extends upwardly from the upper surface of the bottom wall. The heating surface of the thick-film heating element may be positioned in the housing.

The housing may define a steam-generating vessel which includes an outer wall which extends upwardly from the upper surface of the bottom wall of the tub. The outer wall has a lower edge which is secured to the upper surface of the bottom wall of the tub. A lower wall of the steam-generating vessel is secured to the outer wall at a location between the lower edge of the outer wall and the upper edge of the outer wall. The heating surface of the thick-film heating element is in thermal contact with the lower wall of the steam-generating vessel.

The outer wall of the steam-generating vessel may be cylindrically shaped.

The outer wall of the steam-generating vessel may include a continuous wall that envelops the lower wall of the steam-generating vessel such that the outer wall of the steam-generating vessel and the lower wall of the steam-generating vessel create a fluid-retaining cavity.

The bottom wall of the tub may have a recirculation sump formed therein. The recirculation sump extends downwardly from the upper surface of the bottom wall of the tub.

According to yet another aspect, a dishwasher includes a tub defining a washing chamber. The tub includes a bottom wall having an upper surface which faces the washing chamber and a lower surface which faces away from the washing chamber. The bottom wall has formed therein a recirculation sump which extends downwardly from the upper surface of the bottom wall. A number of dish racks are positioned in the chamber. A steam-generating vessel is positioned on the upper surface of the bottom wall of the tub. A heating element is housed in the steam-generating vessel. The heating element is operable to heat the steam-generating vessel.

The steam-generating vessel may include an outer wall which extends upwardly away from the upper surface of the bottom wall of the tub. The outer wall may include a lower edge which is secured to the upper surface of the bottom wall of the tub, and a lower wall secured to the outer wall at a location between the lower edge of the outer wall and the upper edge of the outer wall.

The outer wall of the steam-generating vessel may be cylindrically shaped.

The outer wall of the steam-generating vessel may be embodied as a continuous wall that envelops the lower wall of the steam-generating vessel so as to create a fluid-retaining cavity.

Both the outer wall and the lower wall of the steam-generating vessel may be formed in the bottom wall of the tub.

The steam-generating vessel may be secured to the bottom wall of the tub by a number of fasteners.

The heating element may be embodied as a thick-film heating element.

BRIEF DESCRIPTION OF THE DRAWINGS

The detailed description particularly refers to the following figures, in which.

DETAILED DESCRIPTION OF THE DRAWINGS

Figure 1:
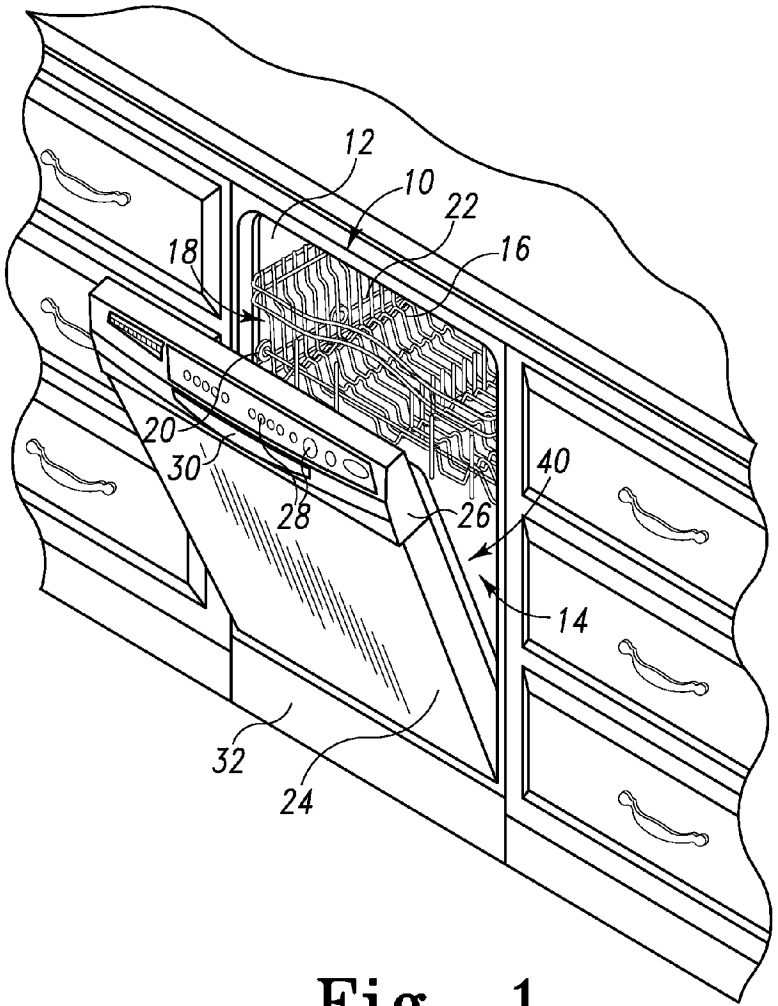
FIG. 1 is fragmentary perspective view of a dishwasher installed in a kitchen cabinet.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring now to FIG. 1, there is shown a dishwasher 10 having a tub 12 which defines a washing chamber 14 into which dishes and other cooking and eating wares (e.g., plates, bowls, glasses, flatware, pots, pans, bowls, etcetera) are placed to be washed. The dishwasher 10 includes a number of racks 16 located in the tub 12. An upper dishwasher rack 16 is shown in FIG. 1, although a lower dishwasher rack is also included in the dishwasher 10. A number of roller assemblies 18 are positioned between the dishwasher rack 16 and the tub 12. The roller assemblies 18 allow the dishwasher racks 16 to extend from, and retract back into, the tub 12. Such movement facilitates the loading and unloading of the dishwasher racks 16. The roller assemblies 18 include a number of rollers 20 which roll along the top of, and in some cases the top and bottom of, a corresponding support rail 22.

A door 24 is hinged to the lower front edge of the tub 12. The door 24 permits access to the tub 12 to load and unload the dishwasher 10. The door 24 also seals the front of the dishwasher 10 during a wash cycle. A control panel 26 is located at the top of the door 24. The control panel 26 includes a number of controls 28, such as buttons and knobs, that are used to control operation of the dishwasher 10. A handle 30 is also included in the control panel 26. The handle 30 is operable by a user to unlatch the door 24 so that it may be opened by a user.

A machine compartment 32 is located below the tub 12. The machine compartment 32 is sealed from the tub 12. In other words, unlike the tub 12, the machine compartment 32 does not fill with water during operation of the dishwasher 12. The machine compartment 32 houses components such as the dishwasher's water pump(s) and valve(s), along with the associated wiring and plumbing.

Figure 2:
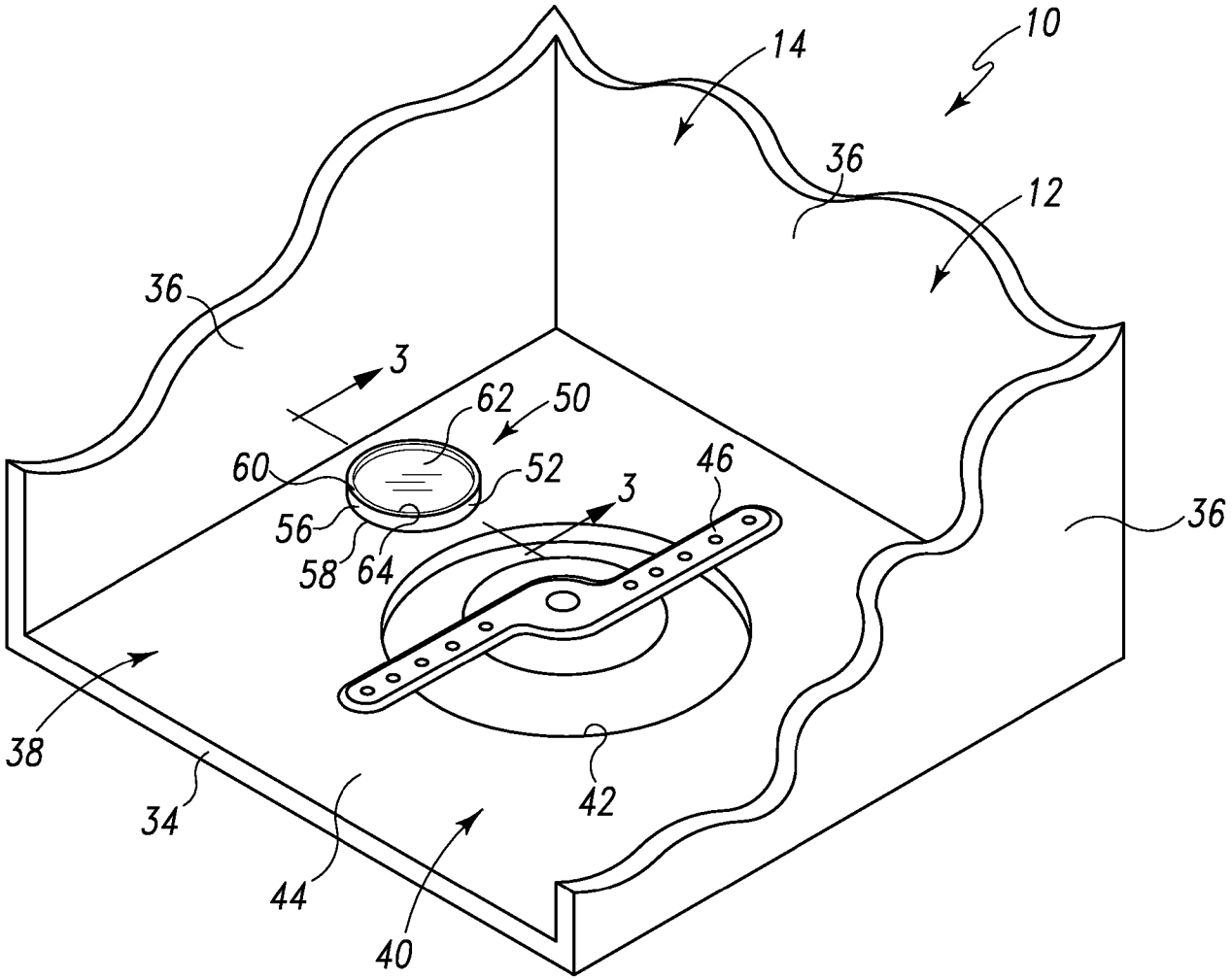
FIG. 2 is a fragmentary perspective view of the tub of the dishwasher of FIG. 1.

Referring now to FIG. 2, there is shown the dishwasher's tub 12 in greater detail. The tub 12 includes a bottom wall 34 having a number of side walls 36 extending upwardly therefrom to define the washing chamber 14. The open front side 38 of the tub 12 defines an access opening 40 of the dishwasher 10. User access to the dishwasher racks 16 positioned in the washing chamber 14 is provided through the access opening 40. As such, when the door 24 is closed, user access to the dishwasher racks 16 is prevented, whereas user access to the dishwasher racks 16 is permitted when the door 24 is open. The door 24 also functions to seal the dishwasher 10 so that water does not escape the access opening 40 of the dishwasher 10 during a wash cycle.

Figure 3:
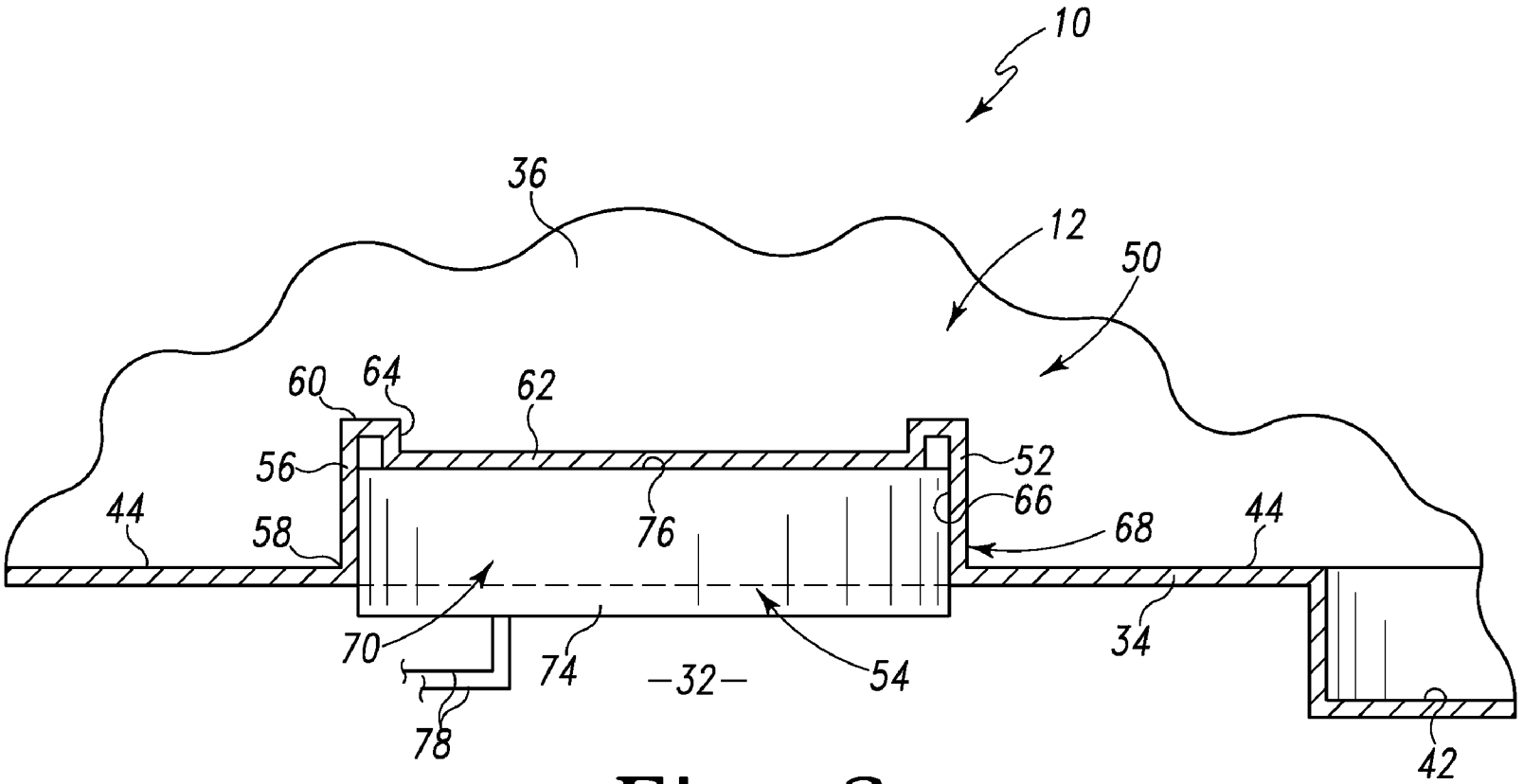
FIG. 3 is an enlarged fragmentary cross sectional view taken along the line 3-3 of FIG. 2, note the thick-film heating element is not shown in cross section for clarity of description.

The bottom wall 34 of the tub 12 has a recirculation sump 42 formed therein. The recirculation sump 42 is formed (e.g., stamped) into the bottom wall 34 of the tub 12. In particular, as shown in FIGS. 2 and 3, the recirculation sump 42 defines a reservoir which extends downwardly in a direction away from the upper surface 44 of the bottom wall 34. The sloped configuration of the bottom wall 34 of the tub 12 directs the wash chemistry (i.e., water and detergent) into the recirculation sump 42 during a wash cycle. Such wash chemistry is drained from the recirculation sump 42 and re-circulated onto the dish racks 16 by a pump (not shown) located in the mechanical compartment 32. The output from the pump is connected to a rotating spray arm 46 which sprays the water and/or wash chemistry onto the dish racks 16 (and hence the wares being washed).

The dishwasher 10 also includes a steam generator 50. In the illustrative embodiment described herein, the steam generator 50 includes a steam-generating vessel 52 and a heating element 54. Similarly to the recirculation sump 42, the steam generating vessel 52 is formed (e.g., stamped) into the bottom wall 34 of the tub 12. However, unlike the recirculation sump 42 which extends downwardly from the upper surface 44 of the bottom wall 34, the steam-generating vessel 52 extends upwardly from the upper surface 44 of the bottom wall 34. In particular, the steam-generating vessel 52 includes an outer wall 56 which has a lower edge 58 secured to the upper surface 44 of the bottom wall 34 of the tub 12. The outer wall 56 extends upwardly from the upper surface 44 of the bottom wall 34 of the tub 12 to its upper edge 60. A lower wall 62 of the steam-generating vessel 52 is secured to the outer wall 56 at a location between the lower edge 58 of the outer wall 56 and its upper edge 60.

As shown in FIGS. 2 and 3, the outer wall 56 of the steam-generating vessel 52 is embodied as a continuous wall that envelops the lower wall 62 of the steam-generating vessel 52. As such, the outer wall 56 of the steam-generating vessel 52 and the lower wall 62 of the steam-generating vessel 52 create a fluid-retaining cavity 64. In the illustrative embodiment described herein, the outer wall 56 of the steam-generating vessel 52 is cylindrically shaped. Such an embodiment likewise creates a cylindrically-shaped fluid-retaining cavity 64.

As will be discussed below in greater detail, water (or water and an additive such as wash detergent) accumulates in the fluid-retaining cavity 64. Such accumulated water is heated by the heating element 54 to generate steam. To do so, the height of the outer wall 56 of the steam-generating vessel 52 is configured such that its upper edge 60 is positioned above the waterline present in the tub 12 thereby allowing water to be maintained in the fluid-retaining cavity 64 for steam generation by the heating element 54. It should be appreciated that the height of the outer wall 56, along with the location of the lower wall 62 within the steam-generating vessel 52, determines the volume of the fluid-retaining cavity 64 and hence the amount of steam generated by the steam generator 50. In the exemplary embodiment described herein, the fluid-retaining cavity 64 has a volume of 100-150 milliliters. Such a volume facilitates the implementation of a batch steam process in which 100-150 grams of steam is generated at a time with the steam generator 50 being refilled numerous times (e.g., 4-10 times) to reach a desired temperature inside the tub 12. In such an arrangement, the heating element 54 (or other sensor) may signal when the steam generator 50 is empty to commence a refill. For example, the material temperature of the heating element 54 (e.g., the thick-film material) rises when all of the water has evaporated from the steam generator 50. Such a temperature rise can be detected and communicated to the dishwasher's control board (not shown) thereby indicating that the steam generator 50 is in need of a refill.

As shown in FIG. 3, the heating element 54 is located in the machine compartment 32 in a position that allows it to heat the water contained in the fluid-retaining cavity 64. In particular, the heating element 54 is positioned within a portion of the machine compartment 32 defined by an inner volume 66 of the steam-generating vessel 52. In such a way, the steam-generating vessel 52 also defines a housing 68 which houses the heating element 54.

The heating element 54 may be embodied as any type of electric heating element such as a cal-rod, mica, or positive temperature coefficient (PTC) heater. One particularly useful heating element for use as the heating element 54 is a thick-film heating element 70. A thick-film heating element is a device that includes a stainless steel or ceramic substrate (e.g., a plate) on which an insulation layer is applied. A layer of resistive paste is printed on the insulation layer, and a protective insulation layer covers the resistive paste. Such individual layers are typically applied by screen printing and each layer is dried and fired after it is applied. Such thick-film heating elements feature a quick temperature rise, an extremely low thermal capacity, and relatively low temperature fluctuations. Relatively high efficiency (e.g., 70-95%) can be achieved depending on the implementation (e.g., direct or indirect heating). Currently, such devices are capable of generating a temperature of up to 500° C., and are available in sizes of up to 150 millimeters in width and 300 millimeters in length. Moreover, in certain configurations, thick-film heating elements are capable of determining when a "hot-spot" is present and thereafter shutting off power. For example, if a utensil falls through the rack and lands on the thick-film heating element, the element is able to detect a local hot spot and shut off power.

The thick-film heating element 70 is operable to heat the water (and/or wash chemistry) contained in the steam-generating vessel 52. Specifically, the thick-film heating element 70 includes a base 74 with a heating surface 76 extending outwardly therefrom. The heating surface 76 of the thick-film heating element 70 is positioned in the housing 68 of the steam-generating vessel 52. As such, the heating surface 76 of the thick-film heating element 70 is positioned in thermal contact with the lower wall 62 of the steam-generating vessel 52. In the illustrative embodiment described herein, the heating surface 76 of the thick-film heating element 70 is positioned in direct contact with the lower wall 62 of the steam-generating vessel 52 (i.e., in direct contact with the portion of the lower surface of the tub's bottom wall 34 that defines the lower wall 62 of the steam-generating vessel 52).

The thick-film heating element 70 is electrically coupled to a power source (not shown) via a pair of wires 78. In the illustrative embodiment described herein, the power source and the associated wires 78 are positioned in the machine compartment 32.

In operation, the steam generator 50 may be operated to generate steam within the washing chamber 14. Steam has been shown to have a positive impact on the cleaning of certain tough soils. Initially, water may be added to the steam-generating vessel 52 (i.e., filled in the fluid-retaining cavity 64) by spraying water into the washing chamber 14 through the rotating spray arm 46. Water (along with, in some cases, detergent) is also added to the steam-generating vessel 52 as a byproduct of a normal wash cycle. If need be, a separate water valve (not shown) may also be used to fill the cavity 64 of the steam-generating vessel 52.

Once filled with water (and/or wash chemistry), the thick-film heating element 70 may be operated to generate steam. Specifically, power is supplied to the thick-filled heating element 70 thereby causing it to generate heat. This heat is transferred to the lower wall 62, and to some extent the outer wall 56, of the steam-generating vessel 52. This heats the water (and/or wash chemistry) contained in the steam-generating vessel 52 to a temperature that causes it to boil thereby generating steam.

The continual dilution of the water in the steam-generating vessel 52 caused by the inherent refilling of it during the cleaning and rinse cycle (and subsequent cycles) prevents the accumulation of food soils in the fluid-retaining cavity 64 of the steam-generating vessel 52. Such continual dilution of the water in the steam-generating vessel 52 also reduces calcium (and other mineral) deposits from, for example, the use of hard water. Moreover, a rinse cycle with citric acid may be used to remove any additional scaling from the steam-generating vessel 52.

Figure 4:
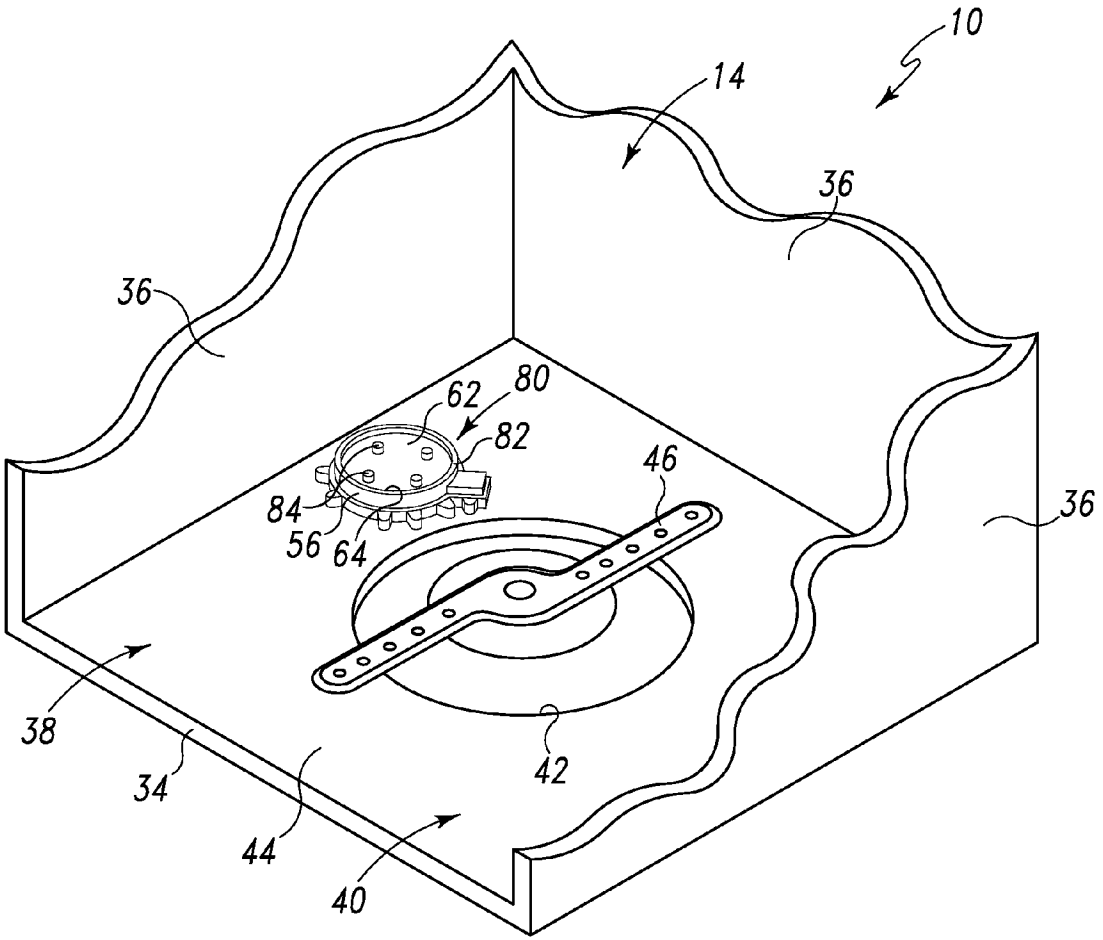
FIG. 4 is a view similar to FIG. 2, but showing a discreet steam generator installed in the tub.

Referring now to FIG. 4, there is shown another embodiment of a steam generator (hereinafter referred to with reference numeral 80). The steam generator 80 is substantially the same as the steam generator 50 except for the configuration of the heating vessel. Namely, in lieu of a heating vessel formed into the bottom wall 34 of the tub 12, the heating vessel 82 of the steam generator 80 is embodied as a separate component that is secured to the bottom wall 34 of the tub 12 by the use of a number of fasteners 84 such as bolts or screws. A number of seals (not shown) may be used to seal the heating vessel 82 to the tub 12. In such an embodiment, the heating element 54 may be positioned in the machine compartment 32 (if a hole is formed in the bottom wall 34 of the tub 12), or, alternatively, may be positioned in the sealed area between the heating vessel 82 and the tub 12.

In addition to the embodiments shown in FIGS. 1-4, other embodiments of a steam generator are also contemplated for use. For example, a ring may be secured to a relatively flat part of the bottom wall 34 of the tub 12. The diameter and wall height of the ring may be configured to create a desired volume within the ring. A thick-film heating element 70 may be secured to the lower surface of the bottom wall 34 (i.e., in the machine compartment 32) at a location directly below the ring. Water (and/or wash chemistry) accumulates in such a ring in a similar manner to as described above in regard to the steam generator 50. The thick-film heating element 70 heats the portion of the bottom wall 34 within the ring thereby heating the water contained within the ring to generate steam. It should be appreciated that because the heat generated from a thick-film heating element is highly concentrated, the ring may be made out of relatively low temperature materials, including plastic.

Figure 5:
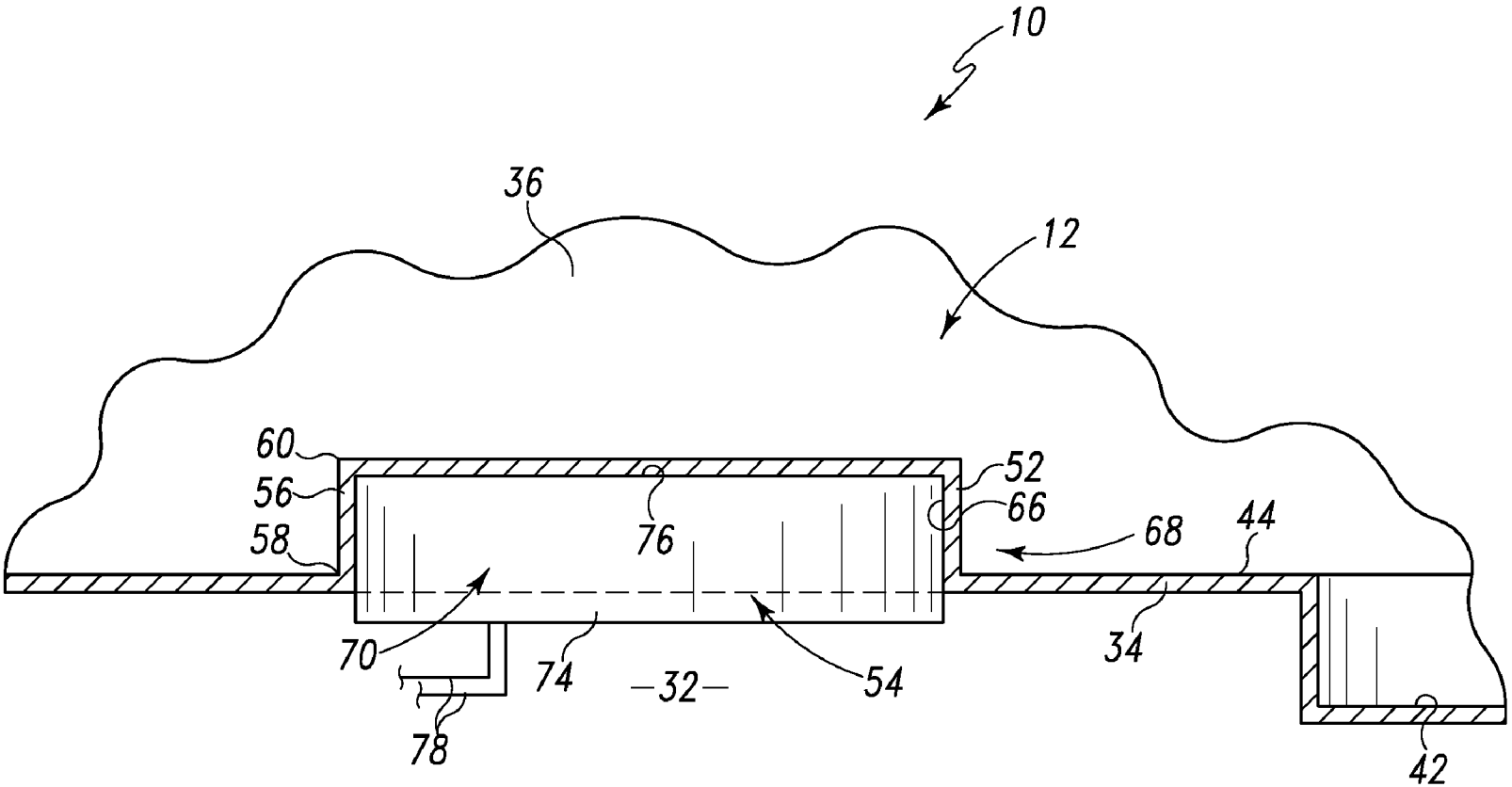
FIG. 5 is view similar to FIG. 3, but showing an alternate configuration of the housing which houses the thick-film heating element.

Referring now to FIG. 5, another application of the thick-film heating element 70 is shown. In this case, the depression formed in the tub 12 to accommodate the thick-film heating element 70 does not include a fluid-retaining cavity 64. Rather, the depression functions only as a housing 68 to house the heating element 54. In such a way, the thick-film heating element 70 is used to heat the water within the tub 12 (i.e., heat the water and/or wash chemistry during a cleaning cycle), but is not used to generate steam. It should be appreciated that such a use may also be achieved in some embodiments by simply securing the upper surface of the thick-film heating element 70 to the lower surface of a substantially flat portion of the bottom wall 34 of the tub 12.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the apparatus, system, and method described herein. It will be noted that alternative embodiments of the apparatus, system, and method of the present disclosure may not include all of the features described yet still benefit from at least some of the advantages of such features. Those of ordinary skill in the art may readily devise their own implementations of the apparatus, system, and method that incorporate one or more of the features of the present invention and fall within the spirit and scope of the present disclosure as defined by the appended claims.

The invention claimed is:

1. A dishwasher, comprising:

a tub defining a washing chamber, the tub comprises a bottom wall having an upper surface which faces the washing chamber and a lower surface which faces away from the washing chamber, wherein the bottom wall has formed therein: (i) a recirculation sump which extends downwardly from the upper surface of the bottom wall, and (ii) a steam-generating vessel which includes an outer wall and a lower wall configured to create a fluid retaining cavity, the lower wall being positioned above the upper surface of the bottom wall, a number of dish racks positioned in the washing chamber, and a heating element positioned below the lower wall of the steam generating vessel, the heating element being operable to heat the steam-generating vessel formed in and integral with the bottom wall of the tub.

2. The dishwasher of claim 1, wherein the outer wall extends upwardly from the upper surface of the bottom wall of the tub, the outer wall having (i) a lower edge which is secured to the upper surface of the bottom wall of the tub, and (ii) an upper edge, and the lower wall is secured to the outer wall at a location between the lower edge of the outer wall and the upper edge of the outer wall.

3. The dishwasher of claim 2, wherein the outer wall of the steam-generating vessel is cylindrically shaped.

4. The dishwasher of claim 2, wherein:

the outer wall of the steam-generating vessel comprises a continuous wall.

5. The dishwasher of claim 2, further comprising a machine compartment located below the bottom wall of the tub, wherein the heating element is located in the machine compartment.

6. The dishwasher of claim 5, wherein the machine compartment is sealed from the washing chamber of the tub.

7. The dishwasher of claim 1, wherein the heating element comprises a thick-film heating element.

8. A dishwasher, comprising:

a tub defining a washing chamber, the tub comprises a bottom wall having an upper surface which faces the washing chamber and a lower surface which faces away from the washing chamber wherein the bottom wall has formed in and integral therewith a housing defining a steam generating vessel, a number of dish racks positioned in the washing chamber, a machine compartment positioned below the bottom wall of the tub, and a thick-film heating element positioned in the machine compartment, the thick-film heating element being operable to heat water located on the bottom wall of the tub to create steam within the washing chamber.

9. The dishwasher of claim 8, wherein:

the thick-film heating element comprises a base with a heating surface extending upwardly therefrom, and the heating surface of the thick-film heating element is in thermal contact with the bottom wall of the tub.

10. The dishwasher of claim 9, wherein the heating surface of the thick-film heating element is positioned in contact with the lower surface of the bottom wall of the tub.

11. The dishwasher of claim 8, wherein:

the housing extends upwardly from the upper surface of the bottom wall, the thick-film heating element comprises a base with a heating surface extending upwardly therefrom, and the heating surface of the thick-film heating element is positioned in the housing.

12. The dishwasher of claim 11, wherein the steam-generating vessel comprises:

an outer wall which extends upwardly from the upper surface of the bottom wall of the tub, the outer wall having (i) a lower edge which is secured to the upper surface of the bottom wall of the tub, and (ii) an upper edge, a lower wall secured to the outer wall at a location between the lower edge of the outer wall and the upper edge of the outer wall, and the heating surface of the thick-film heating element is in thermal contact with the lower wall of the steam-generating vessel.

13. The dishwasher of claim 12, wherein the outer wall of the steam-generating vessel is cylindrically shaped.

14. The dishwasher of claim 12, wherein:

the outer wall of the steam-generating vessel comprises a continuous wall, and the outer wall of the steam-generating vessel and the lower wall of the steam-generating vessel create a fluid-retaining cavity.

15. The dishwasher of claim 8, wherein;

the bottom wall of the tub has a recirculation sump formed therein, and the recirculation sump extends downwardly from the upper surface of the bottom wall of the tub.

16. A dishwasher, comprising:

a tub defining a washing chamber, the tub comprises a bottom wall having an upper surface which faces the washing chamber and a lower surface which faces away from the washing chamber, wherein the bottom wall has formed therein a recirculation sump which extends downwardly from the upper surface of the bottom wall, a number of dish racks positioned in the chamber, and a steam-generating vessel formed in and integral with the upper surface of the bottom wall of the tub, and a heating element housed in the steam-generating vessel, the heating element being operable to heat the steam-generating vessel.

17. The dishwasher of claim 16, wherein the steam-generating vessel comprises:

an outer wall which extends upwardly away from the upper surface of the bottom wall of the tub, the outer wall having (i) a lower edge which is secured to the upper surface of the bottom wall of the tub, and (ii) an upper edge, and a lower wall secured to the outer wall, at a location between the lower edge of the outer wall and the upper edge of the outer wall.

18. The dishwasher of claim 17, wherein the outer wall of the steam-generating vessel is cylindrically shaped.

19. The dishwasher of claim 17, wherein:

the outer wall of the steam-generating vessel comprises a continuous wall, and the outer wall of the steam-generating vessel and the lower wall of the steam generating vessel create a fluid-retaining cavity.

20. The dishwasher of claim 16, wherein the heating element comprises a thick-film heating element.

* * * * *